US011566301B2

(12) United States Patent
Yoshimura et al.

(10) Patent No.: US 11,566,301 B2
(45) Date of Patent: Jan. 31, 2023

(54) DUAL-PHASE STAINLESS STEEL, AND METHOD OF PRODUCTION THEREOF

(71) Applicant: JFE Steel Corporation, Tokyo (JP)

(72) Inventors: Yusuke Yoshimura, Tokyo (JP); Hiroki Ota, Tokyo (JP); Masao Yuga, Tokyo (JP); Yuichi Kamo, Tokyo (JP); Kenichiro Eguchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/325,572

(22) PCT Filed: Aug. 22, 2017

(86) PCT No.: PCT/JP2017/029963
§ 371 (c)(1),
(2) Date: Feb. 14, 2019

(87) PCT Pub. No.: WO2018/043214
PCT Pub. Date: Mar. 8, 2018

(65) Prior Publication Data

US 2019/0211416 A1 Jul. 11, 2019

(30) Foreign Application Priority Data

Sep. 2, 2016 (JP) ..... JP2016-171583

(51) Int. Cl.

| | |
|---|---|
| ***C21D 9/08*** | (2006.01) |
| ***C21D 6/00*** | (2006.01) |
| ***C22C 38/60*** | (2006.01) |
| ***C22C 38/52*** | (2006.01) |
| ***C22C 38/54*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/04*** | (2006.01) |
| ***C22C 38/02*** | (2006.01) |
| ***C22C 38/00*** | (2006.01) |
| ***C21D 8/10*** | (2006.01) |

(52) U.S. Cl.

CPC ..... *C21D 9/08* (2013.01); *C21D 6/004* (2013.01); *C21D 6/005* (2013.01); *C21D 6/008* (2013.01); *C21D 8/105* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21D 2211/001* (2013.01); *C21D 2211/005* (2013.01)

(58) Field of Classification Search
None
See application file for complete search history.

(56) References Cited

U.S. PATENT DOCUMENTS

| | | | | |
|---|---|---|---|---|
| 3,574,002 | A | 4/1971 | Hayden, Jr. et al. | |
| 4,816,085 | A | 3/1989 | Flasche et al. | |
| 6,689,231 | B1 * | 2/2004 | Kangas | F16L 9/19 148/519 |
| 8,333,851 | B2 | 12/2012 | Suwabe | |
| 2007/0089810 | A1 | 4/2007 | Sundstrom et al. | |
| 2013/0315776 | A1 | 11/2013 | Yamada et al. | |

FOREIGN PATENT DOCUMENTS

| | | | |
|---|---|---|---|
| CN | 104694830 | A | 6/2015 |
| CN | 104919072 | A | 9/2015 |
| EP | 0151487 | A2 | 8/1985 |
| EP | 2947169 | A1 | 11/2015 |
| EP | 3216888 | A1 | 9/2017 |
| GB | 1158614 | A | 7/1969 |
| JP | 581062 | A | 1/1983 |
| JP | S60165363 | A | 8/1985 |
| JP | 6123713 | A | 2/1986 |
| JP | 61157626 | A | 7/1986 |
| JP | 05302150 | A | 11/1993 |
| JP | 07150244 | A | 6/1995 |
| JP | 07207337 | A | 8/1995 |
| JP | 08176742 | A | 7/1996 |

(Continued)

OTHER PUBLICATIONS

International Search Report and Written Opinion for International Application No. PCT/JP2017/029963, dated Nov. 28, 2017—5 pages.
Extended European Search Report for European Application No. 17 846 219.8, dated May 21, 2019, 10 pages.
Chinese Office Action for Chinese Application No. 201780050078.6, dated Oct. 19, 2020, with Concise Statement of Relevance of Office Action, 8 pages.
Chinese Office Action with Search Report for Chinese Application No. 201780050078.6, dated Jun. 2, 2020, 10 pages.
Chinese Office Action for Chinese Application No. 201780050078.6, dated Mar. 12, 2021, with Concise Statement of Relevance of Office Action, 7 pages.

(Continued)

*Primary Examiner* — Anthony M Liang
(74) *Attorney, Agent, or Firm* — RatnerPrestia

(57) ABSTRACT

Provided herein is a dual-phase stainless steel having excellent carbon dioxide corrosion resistance, excellent sulfide stress corrosion cracking resistance, and excellent sulfide stress cracking resistance. The dual-phase stainless steel contains, in mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: less than 0.07%, and the balance Fe and unavoidable impurities, and has a structure that is 20 to 70% austenite phase, and 30 to 80% ferrite phase in terms of a volume fraction.

4 Claims, 1 Drawing Sheet

(56) References Cited

FOREIGN PATENT DOCUMENTS

| | | | |
|---|---|---|---|
| JP | 1060526 | A | 3/1998 |
| JP | 2006519313 | A | 8/2006 |
| JP | 2009046759 | A | 3/2009 |
| JP | 2016117944 | A | 6/2016 |
| WO | 2012111537 | A1 | 8/2012 |
| WO | 2016072244 | A1 | 5/2016 |

OTHER PUBLICATIONS

Non Final Office Action for U.S. Appl. No. 16/476,970, dated Jul. 29, 2021, 11 pages.
Final Office Action for U.S. Appl. No. 16/476,970, dated Dec. 13, 2021, 13 pages.
Non Final Office Action for U.S. Appl. No. 16/476,970, dated Aug. 23, 2022, 10 pages.

* cited by examiner

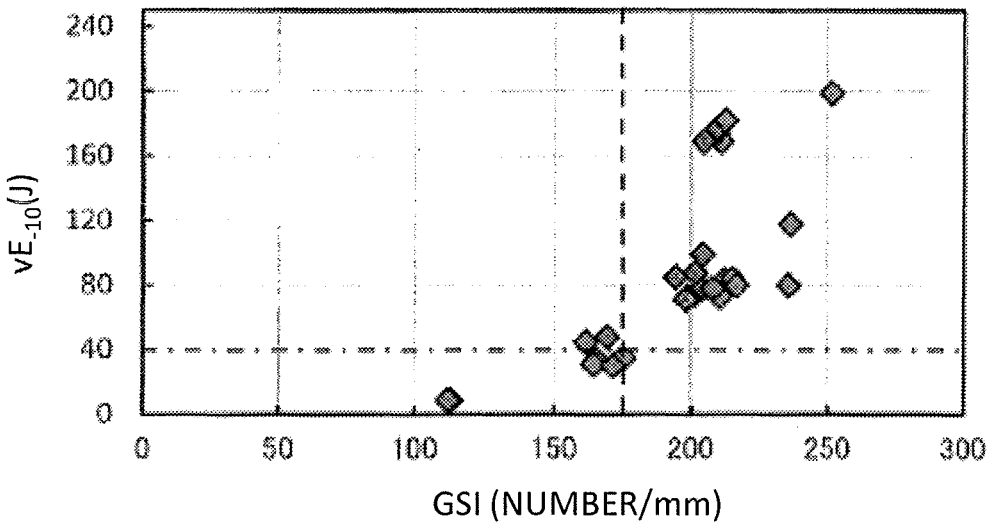
240
200
160
120
80
40
0
vE-10(J)
0
50
100
150
200
250
300
GSI (NUMBER/mm)

DUAL-PHASE STAINLESS STEEL, AND METHOD OF PRODUCTION THEREOF

CROSS REFERENCE TO RELATED APPLICATIONS

This is the U.S. National Phase application of PCT/JP2017/029963, filed Aug. 22, 2017, which claims priority to Japanese Patent Application No. 2016-171583, filed Sep. 2, 2016, the disclosures of these applications being incorporated herein by reference in their entireties for all purposes.

FIELD OF THE INVENTION

The present invention relates to a dual-phase stainless steel preferred for use in oil country tubular goods and gas well applications such as in crude oil wells and natural gas wells, and to a method for producing such a dual-phase stainless steel. A dual-phase stainless steel of the present invention is applicable to provide a seamless stainless steel pipe preferred for use in oil country tubular goods and having high strength, high toughness, and excellent corrosion resistance, particularly excellent carbon dioxide corrosion resistance in a severe high-temperature corrosive environment containing carbon dioxide gas ($CO_2$) and chlorine ions ($Cl^-$), and excellent sulfide stress corrosion cracking resistance (SCC resistance) under low temperature, and excellent sulfide stress cracking resistance (SSC resistance) under room temperature in an environment containing hydrogen sulfide ($H_2S$).

BACKGROUND OF THE INVENTION

Rising crude oil prices, and the increasing shortage of petroleum resources have prompted active development of deep oil fields that were unthinkable in the past, and oil fields and gas fields of a severe corrosive environment, or a sour environment as it is also called, where hydrogen sulfide and other corrosive gases are present. Such oil fields and gas fields are typically very deep, and involve a severe, high-temperature corrosive environment of an atmosphere containing $CO_2$, $Cl^-$, and $H_2S$. Steel pipes for oil country tubular goods intended for use in such an environment need to be made of materials having high strength, high toughness, and high corrosion resistance (carbon dioxide corrosion resistance, sulfide stress corrosion cracking resistance, and sulfide stress cracking resistance).

Oil country tubular goods (OCTG) used for mining of oil fields and gas fields of an environment containing $CO_2$, $Cl^-$, and the like often use dual-phase stainless steel pipes.

For example, PTL 1 discloses a dual-phase stainless steel of a composition containing, in mass %, C≤0.03%, Si≤1.0%, Mn≤1.5%, P≤0.03%, S≤0.0015%, Cr: 24 to 26%, Ni: 9 to 13%, Mo: 4 to 5%, N: 0.03 to 0.20%, Al: 0.01 to 0.04%, O≤0.005%, Ca: 0.001 to 0.005%, restricted additive amounts of S, O, and Ca, and restricted amounts of Cr, Ni, Mo, and N, which greatly contribute to the phase balance that affects hot workability. The dual-phase stainless steel can have improved $H_2S$ corrosive resistance with the optimized Cr, Ni, Mo, and N contents within the limited ranges, while maintaining the same levels of hot workability achievable with traditional steels.

However, the technique described in PTL 1 can only achieve a yield strength as high as about 80 ksi (551 MPa), and is applicable to only some types of steel pipes for oil country tubular goods applications.

In order to provide a solution to this problem, various high-strength dual-phase stainless steels preferred for use in oil country tubular goods have been proposed.

For example, PTL 2 discloses a method for producing a dual-phase stainless steel pipe. The method is intended to produce a steel pipe by cold drawing of a steel material for cold drawing prepared by hot working or by hot working and an additional solid-solution heat treatment of a dual-phase stainless steel material containing, in mass %, C: 0.03% or less, Si: 1% or less, Mn: 0.1 to 2%, Cr: 20 to 35%, Ni: 3 to 10%, Mo: 0 to 4%, W: 0 to 6%, Cu: 0 to 3%, N: 0.15 to 0.35%, and the balance Fe and impurities. In this method, the cold drawing is performed under the conditions that Rd, which represents the extent of working in terms of a percentage reduction of a cross section after the final cold drawing, is 5 to 35%, and that Rd (%)≥(MYS−55)/17.2−{1.2×Cr+3.0×(Mo+0.5×W)}. In this way, the method produces a dual-phase stainless steel pipe having the required corrosion resistance and strength for oil country tubular goods.

PTL 3 discloses a method for producing a high-strength dual-phase stainless steel having improved corrosion resistance. The method includes heating a Cu-containing austenite-ferrite dual-phase stainless steel to 1,000° C. or more for hot working, and directly quenching the steel from a temperature of 800° C. or more, followed by aging.

PTL 4 discloses a method for producing a seawater-resistant, precipitation strengthened dual-phase stainless steel. The method uses a seawater-resistant, precipitation strengthened dual-phase stainless steel that contains, in weight %, C: 0.03% or less, Si: 1% or less, Mn: 1.5% or less, P: 0.04% or less, S: 0.01% or less, Cr: 20 to 26%, Ni: 3 to 7%, Sol-Al: 0.03% or less, N: 0.25% or less, Cu: 1 to 4%, and further one or two of Mo: 2 to 6%, and W: 4 to 10%, and elements including Ca: 0 to 0.005%, Mg: 0 to 0.05%, B: 0 to 0.03%, Zr: 0 to 0.3%, and a total of 0 to 0.03% of Y, La, and Ce, and that satisfies PT≥35, and 70≥G≥30, where PT is the seawater-resistance index PT, and G is the austenite fraction. In the method, the steel is subjected to a solution treatment at 1,000° C. or more, and to an aging heat treatment in a temperature range of 450 to 600° C. to produce a seawater-resistant, precipitation strengthened dual-phase stainless steel.

PTL 5 discloses a method for producing a high-strength dual-phase stainless steel material that can be used in deep oil country tubular goods, and in oil country tubular goods logging lines for gas well. The method includes subjecting a solution-treated Cu-containing austenite-ferrite dual-phase stainless steel material to cold working with a cross section percentage reduction of 35% or more, heating the steel to 800 to 1,150° C. at a heating rate of 50° C./sec or more, and quenching the steel, followed by cold working after 300 to 700° C. warm working, or aging performed at 450 to 700° C. after the cold working.

PTL 6 discloses a method for producing a dual-phase stainless steel for sour gas oil country tubular goods. The method uses a steel containing C: 0.02 wt % or less, Si: 1.0 wt % or less, Mn: 1.5 wt % or less, Cr: 21 to 28 wt %, Ni: 3 to 8 wt %, Mo: 1 to 4 wt %, N: 0.1 to 0.3 wt %, Cu: 2 wt % or less, W: 2 wt % or less, Al: 0.02 wt % or less, Ti: 0.1 wt % or less, V: 0.1 wt % or less, Nb: 0.1 wt % or less, Ta: 0.1 wt % or less, Zr: 0.01 wt % or less, B: 0.01 wt % or less, P: 0.02 wt % or less, and S: 0.005 wt % or less. The steel is subjected to a solution heat treatment at 1,000 to 1,150° C., and to an aging heat treatment at 450 to 500° C. for 30 to 120 minutes.

PTL 7 discloses a method for producing a ferrite stainless steel for cold working. In this method, a steel containing, in weight %, C: 0.0100% or less, Si: 0.40% or less, Mn: 0.50% or less, Ni: less than 0.20%, Cr: 11.0 to 18.0%, N: 0.0120% or less, Nb: 0 to 0.10%, Ti: 0 to 0.10%, Al: 0 to 0.10%, Mo: 0 to 0.50%, Cu: 0 to 0.50%, and the balance Fe and unavoidable impurities is heated to a temperature of 950° C. or less and 700° C. or more, and hot rolled under a controlled finishing temperature of 850° C. or less and 700° C. or more to produce a fine initial grain size for the material, and thereby improve toughness.

PATENT LITERATURE

PTL 1: JP-A-Hei5-302150
PTL 2: JP-A-2009-46759
PTL 3: JP-A-Sho61-23713
PTL 4: JP-A-Hei10-60526
PTL 5: JP-A-Hei7-207337
PTL 6: JP-A-Sho61-157626
PTL 7: JP-A-Hei7-150244

SUMMARY OF THE INVENTION

As the development of oil fields and gas fields of a severe corrosive environment continues, steel pipes for oil country tubular goods are required to have high strength, high toughness, and high corrosion resistance. Here, corrosion resistance includes all of carbon dioxide corrosion resistance under a high temperature of 200° C. or more, sulfide stress corrosion cracking resistance (SCC resistance) under a low temperature of 80° C. or less, and sulfide stress cracking resistance (SSC resistance) under a room temperature of 20 to 30° C. in a severe, $CO_2$, $Cl^-$—, and $H_2S$-containing high-temperature corrosive environment. Improvements are also needed for economy (including cost and efficiency).

However, the technique described in PTL 2 is insufficient, though some improvements are made in corrosion resistance, strength, and toughness. The method of production involving cold drawing is also problematic in terms of cost, and requires a long time for production because of low efficiency. The technique described in PTL 3 achieves high strength with a yield strength of 655 MPa or more without cold drawing, but is problematic in terms of low-temperature toughness. The techniques described in PTL 4 to PTL 6 can achieve high strength with a yield strength of 655 MPa or more without cold drawing. However, these techniques are also problematic in terms of sulfide stress corrosion cracking resistance and sulfide stress cracking resistance in a low temperature range of 80° C. or less.

Aspects of the present invention are intended to provide solutions to the foregoing problems, and it is an object according to aspects of the present invention to provide a dual-phase stainless steel, preferred for use in oil country tubular goods and gas well applications such as in crude oil wells and natural gas wells, having high strength, high toughness, and excellent corrosion resistance (specifically, carbon dioxide corrosion resistance, sulfide stress corrosion cracking resistance, and sulfide stress cracking resistance even in a severe corrosive environment such as described above). Aspects of the invention are also intended to provide a method for producing such a dual-phase stainless steel.

As used herein, "high-strength" means a yield strength of 95 ksi or more, specifically a strength with a yield strength of about 95 ksi (655 MPa) or more. As used herein, "high toughness" means low-temperature toughness, specifically an absorption energy $vE_{-10}$ of 40 J or more as measured by a Charpy impact test at −10° C. As used herein, "excellent carbon dioxide corrosion resistance" means that a test piece dipped in a test solution (20 mass % NaCl aqueous solution; liquid temperature: 200° C.; 30 atm $CO_2$ gas atmosphere) charged into an autoclave has a corrosion rate of 0.125 mm/y or less after 336 hours in the solution. As used herein, "excellent sulfide stress corrosion cracking resistance" means that a test piece dipped in a test solution (a 10 mass % NaCl aqueous solution; liquid temperature: 80° C.; a 2 MPa $CO_2$ gas, and 35 kPa $H_2S$ atmosphere) charged into an autoclave does not crack even after 720 hours under an applied stress equal to 100% of the yield stress. As used herein, "excellent sulfide stress cracking resistance" means that a test piece dipped in a test solution (a 20 mass % NaCl aqueous solution; liquid temperature: 25° C.; a 0.07 MPa $CO_2$ gas, and 0.03 MPa $H_2S$ atmosphere) having an adjusted pH of 3.5 with addition of acetic acid and sodium acetate in a test cell does not crack even after 720 hours under an applied stress equal to 90% of the yield stress.

In order to achieve the foregoing objects, the present inventors conducted intensive studies of a dual-phase stainless steel with regard to various factors that might affect strength and toughness, particularly, low-temperature toughness, carbon dioxide corrosion resistance, sulfide stress corrosion cracking resistance, and sulfide stress cracking resistance. The studies led to the following findings.

It was found that a dual-phase stainless steel having excellent carbon dioxide corrosion resistance, and excellent high-temperature sulfide stress corrosion cracking resistance in a high-temperature, $CO_2$—, $Cl^-$—, and $H_2S$-containing corrosive environment reaching 200° C. or higher temperatures, and in a corrosive environment of a $CO_2$, $Cl^-$, and $H_2S$-containing atmosphere under an applied stress close to the yield strength can be obtained when the steel has a composite structure with a 20 to 70% austenite phase, and a secondary ferrite phase. It was also found that a high strength with a yield strength of 95 ksi (655 MPa) or more is achievable without cold working when the steel contains more than a certain quantity of Cu. Another finding is that nitride generation in an aging heat treatment can be suppressed, and excellent low-temperature toughness can be achieved by reducing the nitrogen content to less than 0.07%. Toughness was also found to improve when the interval GSI value between the phases (ferrite and austenite) as an index of structure fineness is increased, that is, when the interval between the phases is made smaller. Knowing that the main cause of sulfide stress corrosion cracking, and sulfide stress cracking is the active dissolution in a temperature range of 80° C. or more, it was found that (1) hydrogen embrittlement is the main cause of sulfide stress corrosion cracking and sulfide stress cracking in a temperature range of 80° C. or less, and (2) nitrides serve as hydrogen trapping sites, and increase hydrogen absorption, and deteriorate the resistance against hydrogen embrittlement. This led to the finding that reducing the nitrogen content to less than 0.07% is effective at suppressing nitride generation in an aging heat treatment, and preventing sulfide stress corrosion cracking at a temperature of 80° C. or less and sulfide stress cracking.

Aspects of the present invention were completed on the basis of these findings, and aspects of the present invention are as follows.

[1] A dual-phase stainless steel of a composition comprising, in mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: less than 0.07%, and the balance Fe and unavoidable impurities, the dual-phase stainless steel having a structure that is 20 to 70% austenite phase, and 30 to 80% ferrite phase in terms of a volume fraction, a yield strength YS of 655 MPa or more, and an absorption energy $vE_{-10}$ of 40 J or more as measured by a Charpy impact test at a test temperature of −10° C.

[2] The dual-phase stainless steel according to item [1], wherein the composition further comprises, in mass %, W: 0.02 to 1.5%.

[3] The dual-phase stainless steel according to item [1] or [2], wherein the composition further comprises, in mass %, V: 0.02 to 0.20%.

[4] The dual-phase stainless steel according to any one of items [1] to [3], wherein the composition further comprises, in mass %, at least one selected from Zr: 0.50% or less, and B: 0.0030% or less.

[5] The dual-phase stainless steel according to any one of items [1] to [4], wherein the composition further comprises, in mass %, at least one selected from REM: 0.005% or less, Ca: 0.005% or less, Sn: 0.20% or less, and Mg: 0.0002 to 0.01%.

[6] The dual-phase stainless steel according to any one of items [1] to [5], wherein the composition further comprises, in mass %, at least one selected from Ta: 0.01 to 0.1%, Co: 0.01 to 1.0%, and Sb: 0.01 to 1.0%.

[7] The dual-phase stainless steel according to any one of items [1] to [6], wherein the structure has a GSI value of 176 or more at a central portion in the wall thickness of the steel material, the GSI value being defined as the number of ferrite-austenite grain boundaries that are present per unit length (1 mm) of a line segment drawn in a wall thickness direction.

[8] A method for producing a dual-phase stainless steel having a yield strength YS of 655 MPa or more, and an absorption energy $vE_{-10}$ of 40 J or more as measured by a Charpy impact test at a test temperature of −10° C., the method comprising subjecting a stainless steel of a composition comprising, in mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: less than 0.07%, and the balance Fe and unavoidable impurities to the following:

a solution heat treatment in which the stainless steel is heated to a heating temperature of 1,000° C. or more, and cooled to a temperature of 300° C. or less at an average cooling rate of air cooling or faster; and an aging heat treatment in which the stainless steel is heated to a temperature of 350° C. to 600° C., and cooled.

[9] The method according to item [8], wherein the composition further comprises, in mass %, W: 0.02 to 1.5%.

[10] The method according to item [8] or [9], wherein the composition further comprises, in mass %, V: 0.02 to 0.20%.

[11] The method according to any one of items [8] to [10], wherein the composition further comprises, in mass %, at least one selected from Zr: 0.50% or less, and B: 0.0030% or less.

[12] The method according to any one of items [8] to [11], wherein the composition further comprises, in mass %, at least one selected from REM: 0.005% or less, Ca: 0.005% or less, Sn: 0.20% or less, and Mg: 0.0002 to 0.01%.

[13] The method according to any one of items [8] to [12], wherein the composition further comprises, in mass %, at least one selected from Ta: 0.01 to 0.1%, Co: 0.01 to 1.0%, and Sb: 0.01 to 1.0%.

[14] The method according to any one of items [8] o [13], wherein the stainless steel is a seamless steel pipe made from a steel material of the composition by heating and hot working the steel material to prepare a steel pipe material, heating the steel pipe material, forming a steel pipe out of the steel pipe material, and shaping the steel pipe, followed by cooling of air cooling or faster, the hot working involving a total reduction of 30% or more and 50% or less in a temperature range of 1,200° C. to 1,000° C.

Aspects of the present invention can provide a dual-phase stainless steel having high strength with a yield strength of 95 ksi or more (655 MPa or more), and high toughness with an absorption energy $vE_{-10}$ of 40 J or more as measured by a Charpy impact test at −10° C. The dual-phase stainless steel also has excellent corrosion resistance, including excellent carbon dioxide corrosion resistance, excellent sulfide stress corrosion cracking resistance, and excellent sulfide stress cracking resistance, even in a severe corrosive environment containing hydrogen sulfide. A dual-phase stainless steel produced according to aspects of the present invention is applicable to seamless stainless steel pipes for oil country tubular goods, and can reduce the production cost of such pipes. This is highly advantageous in industry.

BRIEF DESCRIPTION OF THE DRAWINGS

The FIGURE is a graph representing the relationship between GSI value and the result of the Charpy impact test conducted in Example of the present invention.

DETAILED DESCRIPTION OF EMBODIMENTS OF THE INVENTION

Embodiments of the present invention are described below in detail.

The following first describes the composition of a dual-phase stainless steel according to aspects of the present invention, and the reasons for specifying the composition. In the following, "%" means percent by mass, unless otherwise specifically stated.

C: 0.03% or Less

Carbon is an element that stabilizes the austenite phase, and improves strength and low-temperature toughness. The carbon content is preferably 0.002% or more to achieve high strength with a yield strength of 95 ksi or more (655 MPa or more), and low-temperature toughness with a $vE_{-10}$ of 40 J or more. However, the carbide precipitation by heat treatment becomes in excess when the carbon content is more than 0.03%. This may also adversely affect the corrosion resistance. For this reason, the upper limit of carbon content is 0.03%. The carbon content is preferably 0.02% or less. The carbon content is more preferably 0.012% or less. More preferably, the carbon content is 0.005% or more.

Si: 1.0% or Less

Silicon is an element that is effective as a deoxidizing agent. Preferably, silicon is contained in an amount of 0.05% or more to obtain this effect. The Si content is more preferably 0.10% or more. However, with a Si content of more than 1.0%, the precipitation of intermetallic compounds by heat treatment becomes in excess, and the corrosion resistance of the steel deteriorates. For this reason, the Si content is 1.0% or less. The Si content is preferably 0.7% or less, more preferably 0.6% or less.

Mn: 0.10 to 1.5%

As is silicon, manganese is an effective deoxidizing agent. Manganese also improves hot workability by fixing the unavoidable sulfur of steel in the form of a sulfide. These effects are obtained with a Mn content of 0.10% or more. However, a Mn content in excess of 1.5% not only deteriorates hot workability, but adversely affects the corrosion resistance. For this reason, the Mn content is 0.10 to 1.5%. The Mn content is preferably 0.15 to 1.0%, more preferably 0.2 to 0.5%.

P: 0.030% or Less

In accordance with aspects of the present invention, phosphorus should preferably be contained in as small an amount as possible because this element deteriorates corrosion resistance, including carbon dioxide corrosion resistance, pitting corrosion resistance, and sulfide stress cracking resistance. However, a P content of 0.030% or less is acceptable. For this reason, the P content is 0.030% or less. Preferably, the P content is 0.020% or less. The P content is preferably 0.005% or more in terms of preventing an increase of manufacturing cost.

S: 0.005% or Less

Preferably, sulfur should be contained in as small an amount as possible because this element is highly detrimental to hot workability, and interferes with a stable operation of the pipe manufacturing process. However, normal pipe production is possible when the S content is 0.005% or less. For this reason, the S content is 0.005% or less. Preferably, the S content is 0.002% or less. The S content is preferably 0.0005% or more in terms of preventing an increase of manufacturing cost.

Cr: 20.0 to 30.0%

Chromium is a basic component that effectively maintains the corrosion resistance, and improves strength. Chromium needs to be contained in an amount of 20.0% or more to obtain these effects. However, a Cr content in excess of 30.0% facilitates precipitation of the σ phase, and deteriorates both corrosion resistance and toughness. For this reason, the Cr content is 20.0 to 30.0%. For improved high strength, the Cr content is preferably 21.4% or more. More preferably, the Cr content is 23.0% or more. From the standpoint of toughness, the Cr content is preferably 28.0% or less.

Ni: 5.0 to 10.0%

Nickel is an element that is added to stabilize the austenite phase, and produce a dual-phase structure. When the Ni content is less than 5.0%, the ferrite phase becomes predominant, and the dual-phase structure cannot be obtained. With a Ni content of more than 10.0%, the austenite phase becomes predominant, and the dual-phase structure cannot be obtained. Nickel is also an expensive element, and such a high Ni content is not favorable in terms of economy. For these reasons, the Ni content is 5.0 to 10.0%, preferably 8.0% or less.

Mo: 2.0 to 5.0%

Molybdenum is an element that improves pitting corrosion resistance due to $Cl^-$ and low pH, and improves sulfide stress cracking resistance, and sulfide stress corrosion cracking resistance. In accordance with aspects of the present invention, molybdenum needs to be contained in an amount of 2.0% or more. A high Mo content in excess of 5.0% causes precipitation of the σ phase, and deteriorates toughness and corrosion resistance. For this reason, the Mo content is 2.0 to 5.0%, preferably 2.5 to 4.5%.

Cu: 2.0 to 6.0%

Copper precipitates in the form of fine ε-Cu in an aging heat treatment, and greatly improves strength. Copper also adds strength to the protective coating, and suppresses entry of hydrogen to the steel, and thereby improves sulfide stress cracking resistance, and sulfide stress corrosion cracking resistance. This makes the copper a very important element in accordance with aspects of the present invention. Copper needs to be contained in an amount of 2.0% or more to obtain these effects. A Cu content in excess of 6.0% results in a low low-temperature toughness value. For this reason, the Cu content is 6.0% or less. Taken together, the Cu content is 2.0 to 6.0%, preferably 2.5 to 5.5%.

N: Less than 0.07%

Nitrogen is known to improve pitting corrosion resistance, and contribute to solid solution strengthening in common dual-phase stainless steels. Nitrogen is actively added in an amount of 0.10% or more. However, the present inventors found that nitrogen actually forms various nitrides in an aging heat treatment, and causes deterioration of low-temperature toughness, and sulfide stress corrosion cracking resistance in a low temperature range of 80° C. or less and sulfide stress cracking resistance and that these adverse effects become more prominent when the N content is 0.07% or more. For these reasons, the N content is less than 0.07%. The N content is preferably 0.03% or less, more preferably 0.015% or less. Preferably, the N content is 0.005% or more in terms of preventing an increase of manufacturing cost.

The composition also contains the balance Fe and unavoidable impurities. Acceptable as unavoidable impurities is O (oxygen): 0.01% or less.

The foregoing components represent the basic components of the composition, and, with these basic components, the dual-phase stainless steel according to aspects of the present invention can have the desired characteristics. In addition to the foregoing basic components, elements selected from the following may be contained in accordance with aspects of the present invention, as needed.

W: 0.02 to 1.5%

Tungsten is an useful element that improves sulfide stress corrosion cracking resistance, and sulfide stress cracking resistance. Preferably, tungsten is contained in an amount of 0.02% or more to obtain such effects. When contained in a large amount in excess of 1.5%, tungsten may deteriorate low-temperature toughness. For this reason, tungsten, when contained, is contained in an amount of 0.02 to 1.5%. The W content is preferably 0.8 to 1.2%.

V: 0.02 to 0.20%

Vanadium is an useful element that improves steel strength through precipitation strengthening. Preferably, vanadium is contained in an amount of 0.02% or more to obtain such effects. When contained in excess of 0.20%, vanadium may deteriorate low-temperature toughness. An excess vanadium content may also deteriorate sulfide stress cracking resistance. For this reason, the V content is preferably 0.20% or less. Taken together, vanadium, when contained, is contained in an amount of 0.02 to 0.20%. More preferably, the V content is 0.04 to 0.08%.

At Least One Selected from Zr: 0.50% or Less, and B: 0.0030% or Less

Zirconium and boron are useful elements that contribute to improving strength, and may be contained by being selected, as needed.

In addition to contributing to improved strength, zirconium also contributes to improving sulfide stress corrosion cracking resistance. Preferably, zirconium is contained in an amount of 0.02% or more to obtain such effects. When contained in excess of 0.50%, zirconium may deteriorate low-temperature toughness. For this reason, zirconium, when contained, is contained in an amount of 0.50% or less. The Zr content is preferably 0.05% or more, more preferably 0.05% to 0.20%.

Boron is a useful element that contributes to improving hot workability, in addition to improving strength. Preferably, boron is contained in an amount of 0.0005% or more to obtain such effects. When contained in excess of 0.0030%, boron may deteriorate low-temperature toughness, and hot workability. For this reason, boron, when contained, is contained in an amount of 0.0030% or less. More preferably, the B content is 0.0010 to 0.0025%.

At Least One Selected from REM: 0.005% or less, Ca: 0.005% or less, Sn: 0.20% or less, and Mg: 0.0002 to 0.01%

REM, Ca, Sn, and Mg are useful elements that contribute to improving sulfide stress corrosion cracking resistance, and may be contained by being selected, as needed. The preferred contents for providing such an effect are 0.001% or more for REM, 0.001% or more for Ca, 0.05% or more for Sn, and 0.0002% or more for Mg. More preferably, REM: 0.0015% or more, Ca: 0.0015% or more, Sn: 0.09% or more, and Mg: 0.0005% or more. It is not always economically advantageous to contain REM in excess of 0.005%, Ca in excess of 0.005%, Sn in excess of 0.20%, and Mg in excess of 0.01% because the effect is not necessarily proportional to the content, and may become saturated. For this reason, REM, Ca, Sn, and Mg, when contained, are contained in amounts of 0.005% or less, 0.005% or less, 0.20% or less, and 0.01% or less, respectively. More preferably, REM: 0.004% or less, Ca: 0.004% or less, Sn: 0.15% or less, and Mg: 0.005% or less.

At Least One Selected from Ta: 0.01 to 0.1%, Co: 0.01 to 1.0%, and Sb: 0.01 to 1.0%

Ta, Co, and Sb are useful elements that contribute to improving $CO_2$ corrosion resistance, sulfide stress cracking resistance, and sulfide stress corrosion cracking resistance, and may be contained by being selected, as needed. The preferred contents for providing such effects are 0.01% or more for Ta, 0.01% or more for Co, and 0.01% or more for Sb. The effect is not necessarily proportional to the content, and may become saturated when Ta, Co, and Sb are contained in excess of 0.1%, 1.0%, and 1.0%, respectively. For this reason, Ta, Co, and Sb, when contained, are contained in amounts of 0.01 to 0.1%, 0.01 to 1.0%, and 0.01 to 1.0%, respectively. Cobalt also contributes to raising the Ms point, and increasing strength. More preferably, Ta: 0.02 to 0.05%, Co: 0.02 to 0.5%, and Sb: 0.02 to 0.5%.

The following describes the structure of the dual-phase stainless steel according to aspects of the present invention, and the reasons for limiting the structure. In the following, "volume fraction" means a volume fraction relative to the whole steel plate structure.

In addition to the foregoing composition, the dual-phase stainless steel according to aspects of the present invention has a composite structure that is 20 to 70% austenite phase, and 30 to 80% ferrite phase in terms of a volume fraction. The composite structure may have a GSI value of 176 or more at a central portion in the wall thickness of the steel material. Here, the GSI value is defined as the number of ferrite-austenite grain boundaries that are present per unit length (1 mm) of a line segment drawn along the wall thickness direction.

When the austenite phase is less than 20%, the desired low-temperature toughness value cannot be obtained. It is also not possible to obtain the desired sulfide stress cracking resistance or sulfide stress corrosion cracking resistance. The desired high strength cannot be provided when the ferrite phase is less than 30%, and the austenite phase is more than 70%. For these reasons, the austenite phase is 20 to 70%. Preferably, the austenite phase is 30 to 60%. The ferrite phase is 30 to 80%, preferably 40 to 70%. The volume fractions of the austenite phase and the ferrite phase can be measured using the method described in the Example section below.

In addition to the austenite phase and the ferrite phase, the composition may contain precipitates such as intermetallic compounds, carbides, nitrides, and sulfides, provided that the total content of these phases is 1% or less. Low-temperature toughness, sulfide stress corrosion cracking resistance, and sulfide stress cracking resistance greatly deteriorate when the total content of these precipitates exceeds 1%.

Aspects of the present invention can further improve toughness when the GSI value, defined as the number of ferrite-austenite grain boundaries, is 176 or more, specifically by reducing the distance between the phases. A toughness of 40 J or more can be obtained even with a GSI value of less than 176, provided that the chemical composition, the structure, and the manufacturing conditions are within the ranges according to aspects of the present invention. However, the toughness can have a higher value of 70 J or more when the GSI value is 176 or more. Large deformation in a pierce-rolling process promotes recrystallization, and increases the GSI value. However, large deformation involves the risk of cracking, and multiple occurrences of deformation lead to a lower yield, and an increased manufacturing cost due to increased numbers of manufacturing steps. The present inventors investigated the relationship between the result of a Charpy impact test, and the GSI value under the conditions described in the Example section below. The result of the investigation is represented in The FIGURE. In the result shown in the FIGURE, the GSI value was 300 in a typical rolling process that did not involve cracking. It is accordingly desirable to set this number as the upper limit of GSI value. The GSI value, defined as the number of ferrite-austenite grain boundaries, may be measured using the method described in the Example section below.

A method of production of the dual-phase stainless steel according to aspects of the present invention is described below.

In accordance with aspects of the present invention, a dual-phase stainless steel of the composition described above is used as a starting material (hereinafter, also referred to as "steel pipe material"). In accordance with aspects of the present invention, the method of production of the starting material dual-phase stainless steel is not particularly limited, and, typically, any known production method may be used.

The following describes a preferred method of production of the dual-phase stainless steel according to aspects of the present invention for seamless steel pipe applications. The present invention is not limited to seamless steel pipes, and has other applications, including thin plates, thick plates, UOE, ERW, spiral steel pipes, and forge-welded pipes.

In a preferred method of production of a steel pipe material of the foregoing composition, for example, a molten steel of the foregoing composition is made into steel using an ordinary steel making process such as by using a converter furnace, and formed into a steel pipe material, for example, a billet, using an ordinary method such as continuous casting, and ingot casting-slab rolling. The steel pipe material is then heated, and formed into a seamless steel pipe of the foregoing composition and of the desired dimensions, typically by using a known pipe manufacturing process, for example, such as extrusion by the Eugene Sejerne method, and hot rolling by the Mannesmann method.

In a preferred method for obtaining a fine structure with a GSI value of 176 or more, for example, the hot working is performed with a total reduction of 30% or more in a temperature range of 1,200° C. to 1,000° C. This promotes recrystallization, and a seamless steel pipe can be produced that includes a structure with a GSI value of 176 or more at a central portion in the wall thickness of the steel material. Here, the GSI value is defined as the number of ferrite-austenite grain boundaries that are present per unit length (1 mm) of a line segment drawn in wall thickness direction. Below 1,000° C., the working temperature would be too low, and increases the deformation resistance. This puts an excessive load on the rolling machine, and hot working becomes difficult. Above 1,200° C., crystals coarsen, and the toughness deteriorates. The temperature range is more preferably 1,100° C. to 1,180° C. When the total reduction in the foregoing temperature range is less than 30%, it is difficult to make the GSI value, or the number of ferrite-austenite grain boundaries per unit length in wall thickness direction, 176 or more. For this reason, the total reduction in the foregoing temperature range is 30% or more. Preferably, the total reduction in the foregoing temperature range is 35% or more. The upper limit of the total reduction in the foregoing temperature range is not particularly specified in accordance with aspects of the present invention. However, from the standpoint of a load on the rolling machine, it is preferable to make the total reduction 50% or less in the foregoing temperature range. More preferably, the total reduction in the foregoing temperature range is 45% or less. As used herein, "total reduction" means a reduction in the wall thickness of the steel pipe rolled with an elongator, a plug mill, or the like after piercing with a piercer.

After production, the seamless steel pipe is cooled to preferably room temperature at an average cooling rate of air cooling or faster.

In accordance with aspects of the present invention, the cooled seamless steel pipe is subjected to a solution heat treatment, in which the steel pipe is further heated to a heating temperature of 1,000° C. or more, and cooled to a temperature of 300° C. or less at an average cooling rate of air cooling or faster, preferably 1° C./s or more. In this way, intermetallic compounds, carbides, nitrides, sulfides, and other such compounds that had previously precipitated can be dissolved, and a seamless steel pipe of a structure containing appropriate amounts of austenite phase and ferrite phase can be produced.

The desired high toughness cannot be provided when the heating temperature of the solution heat treatment is less than 1,000° C. The heating temperature of the solution heat treatment is preferably 1,150° C. or less in terms of preventing coarsening of the structure. More preferably, the heating temperature of the solution heat treatment is 1,020° C. or more. More preferably, the heating temperature of the solution heat treatment is 1,130° C. or less. In accordance with aspects of the present invention, the heating temperature of the solution heat treatment is maintained for at least 5 min from the standpoint of making a uniform temperature in the material. Preferably, the heating temperature of the solution heat treatment is maintained for at least 210 min.

When the average cooling rate of the solution heat treatment is less than 1° C./s, intermetallic compounds, such as the σ phase and the χ phase precipitate during the cooling process, and low-temperature toughness and corrosion resistance seriously deteriorate. The upper limit of average cooling rate is not particularly limited. As used herein, "average cooling rate" means the average of cooling rates from heating temperature to cooling stop temperature.

When the cooling stop temperature of the solution heat treatment is higher than 300° C., precipitation of the α-prime phase occurs subsequently, and low-temperature toughness and corrosion resistance seriously deteriorate. For this reason, the cooling stop temperature of the solution heat treatment is 300° C. or less, more preferably 100° C. or less.

After the solution heat treatment, the seamless steel pipe is subjected to an aging heat treatment, in which the steel pipe is heated to a temperature of 350 to 600° C., maintained for 5 to 210 minutes, and cooled. By the aging heat treatment, the added copper precipitates in the form of ε-Cu, which contributes to strength. This completes the high-strength dual-phase seamless stainless steel pipe having the desired high strength and high toughness, and excellent corrosion resistance.

When the heating temperature of the aging heat treatment is higher than 600° C., the ε-Cu coarsens, and the desired high strength and high toughness, and excellent corrosion resistance cannot be obtained. When the heating temperature of the aging heat treatment is less than 350° C., the ε-Cu cannot sufficiently precipitate, and the desired high strength cannot be obtained. For these reasons, the heating temperature of the aging heat treatment is preferably 350 to 600° C. More preferably, the heating temperature of the aging heat treatment is 400° C. to 550° C. In accordance with aspects of the present invention, the heat of the aging heat treatment is maintained for at least 5 min from the standpoint of making a uniform temperature in the material. The desired uniform structure cannot be obtained when the heat of the aging heat treatment is maintained for less than 5 min. More preferably, the heat of the aging heat treatment is maintained for at least 20 min. Preferably, the heat of the aging heat treatment is maintained for at most 210 min. As used herein, "cooling" means cooling from a temperature range of 350 to 600° C. to room temperature at an average cooling rate of air cooling or faster. Preferably, the average cooling rate is 1° C./s or more.

EXAMPLES

Aspects of the present invention are further described below through Examples. It is to be noted that the present invention is not limited by the following Examples.

Molten steels of the compositions shown in Table 1 were made into steel with a converter furnace, and cast into billets (steel pipe material) by continuous casting. The steel pipe material was then heated at 1,150 to 1,250° C., and hot worked with a heating model seamless rolling machine to produce a seamless steel pipe measuring 83.8 mm in outer diameter and 12.7 mm in wall thickness. After production, the seamless steel pipe was air cooled.

The seamless steel pipe was then subjected to a solution heat treatment, in which the seamless steel pipe was heated under the conditions shown in Table 2, and cooled. This was followed by an aging heat treatment, in which the seamless steel pipe was heated under the conditions shown in Table 2, and air cooled.

From the seamless steel pipe finally obtained after the heat treatment, a test piece for structure observation was collected, and measured for GSI value, and evaluated for the quality of the constituent structure. The test piece was also examined by a tensile test, a Charpy impact test, a corrosion test, a sulfide stress corrosion cracking resistance test (SCC resistance test), and a sulfide stress cracking resistance test (SSC resistance test). The tests were conducted in the manner described below.

(1) Measurement of GSI Value

A test piece for structure observation was collected from a surface perpendicular to the rolling direction of the steel pipe, and that was located at the center in the thickness of the steel pipe. The test piece for structure observation was polished, and corroded with a Vilella's solution (a mixed reagent containing 2 g of picric acid, 10 ml of hydrochloric acid, and 100 ml of ethanol). The structure was observed with a light microscope (magnification: 400 times). From the structure image, the number of ferrite-austenite grain boundaries per unit length (corresponding to 1 mm of the test piece) in wall thickness direction (number of ferrite-austenite grain boundaries/mm) was determined by measurement.

(2) Volume Fractions (volume %) of Phases in the Whole Steel Plate Structure

The volume fraction of the ferrite phase was determined by scanning electron microscopy of a surface perpendicular to the rolling direction of the steel pipe, and that was located at the center in the thickness of the steel pipe. The test piece for structure observation was corroded with a Vilella's reagent, and the structure was imaged with a scanning electron microscope (1,000 times). The mean value of the area percentage of the ferrite phase was then calculated using an image analyzer to find the volume fraction (volume %).

The volume fraction of the austenite phase was measured by the X-ray diffraction method. A test piece to be measured was collected from a surface in the vicinity of the center in the thickness of the test piece material subjected to the heat treatment (solution heat treatment-aging heat treatment), and the X-ray diffraction integral intensity was measured for the (220) plane of the austenite phase (γ), and the (211) plane of the ferrite phase (α) by X-ray diffraction. The result was converted using the following formula.

$$\gamma(\text{Volume fraction})=100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ.

(3) Tensile Characteristics

A strip specimen specified by API standard 5CT was collected from the heat-treated test piece material, and subjected to a tensile test according to the API specifications to determine its tensile characteristics (yield strength YS, tensile strength TS). In accordance with aspects of the present invention, the test piece was evaluated as being acceptable when it had a yield strength of 655 MPa or more.

(4) Charpy Test

A V-notch test piece (10 mm thick) was collected from the heat-treated test piece material according to the JIS Z 2242 specifications. The test piece was subjected to a Charpy impact test, and the absorption energy at −10° C. was determined for toughness evaluation. In accordance with aspects of the present invention, the test piece was evaluated as being acceptable when it had a $vE_{-10}$ of 40 J or more. The test result was sorted in terms of its relation with the GSI value, as shown in the FIGURE.

(5) Corrosion Test

A corrosion test piece, measuring 3 mm in wall thickness, 30 mm in width, and 40 mm in length, was machined from the heat-treated test piece material, and subjected to a corrosion test.

The corrosion test was conducted by dipping the test piece for 14 days in a test solution (a 20 mass % NaCl aqueous solution; liquid temperature: 200° C., a 30-atm $CO_2$ gas atmosphere) charged into an autoclave. After the test, the weight of the test piece was measured, and the corrosion rate was determined from the calculated weight reduction before and after the corrosion test. The test piece after the corrosion test was also observed for the presence or absence of pitting corrosion on a test piece surface using a loupe (10 times magnification). Corrosion with a diameter of 0.2 mm or more was regarded as pitting corrosion. In accordance with aspects of the present invention, the test piece was evaluated as being acceptable when it had a corrosion rate of 0.125 mm/y or less.

(6) Sulfide Stress Cracking Resistance Test (SSC Resistance Test)

A round rod-shaped test piece (diameter ϕ=6.4 mm) was machined from the heat-treated test piece material according to NACE TM0177, Method A, and subjected to an SSC resistance test.

In the SSC resistance test, the test piece was dipped in an aqueous test solution (a 20 mass % NaCl aqueous solution; liquid temperature: 25° C.; $H_2S$: 0.03 MPa; $CO_2$: 0.7 MPa) having an adjusted pH of 3.5 with addition of an aqueous solution of acetic acid and sodium acetate. The test piece was kept in the solution for 720 hours to apply a stress equal to 90% of the yield stress. After the test, the test piece was observed for the presence or absence of cracking. In accordance with aspects of the present invention, the test piece was evaluated as being acceptable when it did not have a crack after the test. In Table 2, the open circle represents no cracking, and the cross represents cracking.

(7) Sulfide Stress Corrosion Cracking Resistance Test (SCC Resistance Test)

A 4-point bend test piece, measuring 3 mm in wall thickness, 15 mm in width, and 115 mm in length, was collected by machining the heat-treated test piece material, and subjected to an SCC resistance test.

In the SCC resistance test, the test piece was dipped in an aqueous test solution (a 10 mass % NaCl aqueous solution; liquid temperature: 80° C.; $H_2S$: 35 kPa; $CO_2$: 2 MPa) charged into an autoclave. The test piece was kept in the solution for 720 hours to apply a stress equal to 100% of the yield stress. After the test, the test piece was observed for the presence or absence of cracking. In accordance with aspects of the present invention, the test piece was evaluated as being acceptable when it did not have a crack after the test. In Table 2, the open circle represents no cracking, and the cross represents cracking.

The results of these tests are presented in Table 2.

TABLE 1

| Steel | Composition (mass %) | | | | | | | | | | |
|---|---|---|---|---|---|---|---|---|---|---|---|
| No. | C | Si | Mn | P | S | Cr | Cu | Ni | Mo | W | V |
| A | 0.006 | 0.53 | 0.33 | 0.011 | 0.0012 | 22.4 | 3.0 | 6.1 | 2.8 | — | 0.061 |
| B | 0.011 | 0.49 | 0.29 | 0.016 | 0.0010 | 25.5 | 3.1 | 8.1 | 4.1 | — | 0.053 |
| C | 0.008 | 0.47 | 0.30 | 0.015 | 0.0010 | 21.4 | 4.7 | 7.0 | 2.8 | — | 0.050 |
| D | 0.012 | 0.49 | 0.30 | 0.014 | 0.0010 | 24.3 | 3.0 | 7.9 | 3.7 | — | 0.052 |
| E | 0.071 | 0.41 | 1.05 | 0.015 | 0.0010 | 24.7 | 1.1 | 5.4 | 1.5 | — | — |
| F | 0.007 | 0.49 | 0.31 | 0.012 | 0.0011 | 21.9 | 3.2 | 6.6 | 3.3 | — | — |
| H | 0.006 | 0.55 | 0.33 | 0.012 | 0.0012 | 21.9 | 3.0 | 6.8 | 2.9 | 0.5 | — |
| I | 0.007 | 0.57 | 0.29 | 0.011 | 0.0013 | 22.2 | 2.8 | 6.5 | 3.3 | — | — |

TABLE 1-continued

| | | | | | | | | | | | |
|---|---|---|---|---|---|---|---|---|---|---|---|
| J | 0.006 | 0.59 | 0.31 | 0.011 | 0.0012 | 22.0 | 3.1 | 7.0 | 3.1 | — | — |
| K | 0.008 | 0.52 | 0.29 | 0.015 | 0.0008 | 24.9 | 3.0 | 6.6 | 3.0 | — | 0.068 |
| L | 0.006 | 0.58 | 0.32 | 0.012 | 0.0011 | 21.8 | 2.7 | 7.1 | 3.2 | — | — |
| M | 0.007 | 0.56 | 0.33 | 0.010 | 0.0011 | 21.9 | 2.9 | 6.3 | 3.0 | — | — |
| N | 0.006 | 0.59 | 0.34 | 0.011 | 0.0012 | 22.7 | 2.7 | 6.2 | 3.0 | — | — |
| O | 0.006 | 0.51 | 0.33 | 0.011 | 0.0011 | 21.7 | 3.0 | 6.5 | 3.2 | — | — |
| P | 0.007 | 0.59 | 0.31 | 0.011 | 0.0012 | 21.6 | 2.7 | 6.6 | 3.1 | — | — |
| Q | 0.006 | 0.54 | 1.34 | 0.010 | 0.0012 | 22.4 | 2.7 | 6.3 | 2.9 | — | 0.071 |
| R | 0.005 | 0.49 | 0.11 | 0.010 | 0.0012 | 22.2 | 3.2 | 6.4 | 2.8 | — | 0.058 |
| S | 0.006 | 0.57 | 1.56 | 0.011 | 0.0013 | 22.4 | 2.9 | 6.3 | 2.9 | — | 0.057 |
| T | 0.005 | 0.55 | 0.31 | 0.011 | 0.0012 | 22.8 | 3.0 | 5.6 | 2.8 | — | 0.053 |
| U | 0.005 | 0.49 | 0.30 | 0.010 | 0.0012 | 22.9 | 3.0 | 6.2 | 2.7 | — | 0.062 |
| V | 0.012 | 0.53 | 0.31 | 0.016 | 0.0010 | 28.6 | 2.8 | 7.6 | 3.8 | — | 0.055 |
| W | 0.012 | 0.45 | 0.32 | 0.017 | 0.0009 | 31.7 | 3.1 | 7.6 | 3.8 | — | 0.059 |
| X | 0.010 | 0.50 | 0.29 | 0.017 | 0.0011 | 24.8 | 2.9 | 12.0 | 3.7 | — | 0.049 |
| Y | 0.011 | 0.46 | 0.26 | 0.018 | 0.0010 | 26.2 | 3.1 | 7.4 | 5.2 | — | 0.046 |
| Z | 0.007 | 0.42 | 0.33 | 0.015 | 0.0010 | 21.7 | 6.1 | 7.2 | 2.7 | — | 0.047 |

| Steel | Composition (mass %) | | | | | | | | | |
|---|---|---|---|---|---|---|---|---|---|---|
| No. | N | Zr | B | REM | Ca | Sn | Mg | Ta | Co | Sb |
| A | 0.007 | — | — | — | — | — | — | — | — | — |
| B | 0.009 | — | — | — | — | — | — | — | — | — |
| C | 0.010 | — | — | — | — | — | — | — | — | — |
| D | 0.010 | — | — | — | — | — | — | — | — | — |
| E | 0.070 | — | — | — | — | — | — | — | — | — |
| F | 0.006 | — | — | — | — | — | — | — | — | — |
| H | 0.006 | — | — | — | — | — | — | — | — | — |
| I | 0.007 | 0.11 | 0.0027 | — | — | — | — | — | — | — |
| J | 0.007 | — | — | 0.0023 | 0.0029 | 0.10 | 0.0008 | 0.044 | 0.042 | 0.051 |
| K | 0.008 | — | — | — | — | — | — | — | — | — |
| L | 0.006 | — | — | 0.0024 | 0.0018 | 0.09 | 0.0011 | — | — | — |
| M | 0.005 | — | — | — | 0.0020 | — | — | — | — | — |
| N | 0.006 | — | 0.0022 | — | — | — | — | — | — | — |
| O | 0.005 | — | — | — | — | — | — | 0.041 | 0.052 | 0.040 |
| P | 0.007 | — | — | — | — | — | — | — | 0.042 | — |
| Q | 0.008 | — | — | — | — | — | — | — | — | — |
| R | 0.006 | — | — | — | — | — | — | — | — | — |
| S | 0.006 | — | — | — | — | — | — | — | — | — |
| T | 0.064 | — | — | — | — | — | — | — | — | — |
| U | 0.075 | — | — | — | — | — | — | — | — | — |
| V | 0.008 | — | — | — | — | — | — | — | — | — |
| W | 0.010 | — | — | — | — | — | — | — | — | — |
| X | 0.008 | — | — | — | — | — | — | — | — | — |
| Y | 0.009 | — | — | — | — | — | — | — | — | — |
| Z | 0.011 | — | — | — | — | — | — | — | — | — |

*Underline means outside the range of the present invention.

TABLE 2

| | | Hot working | Solution heat treatment | | | | Aging heat treatment | | Volume fraction | |
|---|---|---|---|---|---|---|---|---|---|---|
| Steel pipe No. | Steel No. | Total reduction in 1,200 to 1,000° C. temperature range (%) | Heating temperature (° C.) | Duration (min) | Cooling rate (° C./s) | Cooling stop temperature (° C.) | Heating temperature (° C.) | Duration (min) | Volume fraction of ferrite phase (%) | Volume fraction of austenite phase (%) |
| 1 | A | 40 | 1070 | 20 | 25 | 25 | 400 | 180 | 61 | 39 |
| 2 | A | 28 | 1070 | 20 | 25 | 25 | 450 | 60 | 60 | 40 |
| 3 | A | 42 | 1070 | 20 | 25 | 25 | 500 | 60 | 55 | 45 |
| 4 | A | 38 | 1070 | 20 | 25 | 25 | 550 | 30 | 56 | 44 |
| 5 | B | 45 | 1070 | 20 | 25 | 25 | 500 | 60 | 67 | 33 |
| 6 | C | 36 | 1070 | 20 | 25 | 25 | 500 | 60 | 51 | 49 |
| 7 | D | 34 | 1070 | 20 | 25 | 25 | 500 | 60 | 59 | 41 |
| 8 | D | 23 | 950 | 30 | 25 | 25 | 500 | 60 | 68 | 32 |
| 9 | E | 19 | 1070 | 20 | 25 | 25 | 550 | 60 | 57 | 43 |
| 10 | F | 41 | 1070 | 20 | 25 | 25 | 500 | 60 | 60 | 40 |
| 11 | H | 39 | 1070 | 20 | 25 | 25 | 500 | 60 | 60 | 40 |
| 12 | I | 36 | 1070 | 20 | 25 | 25 | 500 | 60 | 58 | 42 |
| 13 | J | 35 | 1070 | 20 | 25 | 25 | 500 | 60 | 58 | 42 |
| 14 | K | 26 | 1070 | 20 | 25 | 25 | 500 | 60 | 79 | 21 |
| 15 | L | 33 | 1070 | 20 | 25 | 25 | 500 | 60 | 56 | 44 |
| 16 | M | 43 | 1070 | 20 | 25 | 25 | 500 | 60 | 61 | 39 |
| 17 | N | 42 | 1070 | 20 | 25 | 25 | 500 | 60 | 61 | 39 |
| 18 | O | 36 | 1070 | 20 | 25 | 25 | 500 | 60 | 59 | 41 |

TABLE 2-continued

| | | | | | | | | | | |
|---|---|---|---|---|---|---|---|---|---|---|
| 19 | P | 32 | 1070 | 20 | 25 | 25 | 500 | 60 | 59 | 41 |
| 20 | Q | 39 | 1070 | 20 | 25 | 25 | 500 | 60 | 66 | 34 |
| 21 | R | 37 | 1070 | 20 | 25 | 25 | 500 | 60 | 55 | 45 |
| 22 | S | 40 | 1070 | 20 | 25 | 25 | 500 | 60 | 62 | 38 |
| 23 | T | 40 | 1070 | 20 | 25 | 25 | 500 | 60 | 57 | 43 |
| 24 | U | 26 | 1070 | 20 | 25 | 25 | 500 | 60 | 54 | 46 |
| 25 | V | 33 | 1070 | 20 | 25 | 25 | 500 | 60 | 73 | 27 |
| 26 | W | 25 | 1070 | 20 | 25 | 25 | 500 | 60 | 87 | 13 |
| 27 | X | 46 | 1070 | 20 | 25 | 25 | 500 | 60 | 19 | 81 |
| 28 | Y | 28 | 1070 | 20 | 25 | 25 | 500 | 60 | 77 | 23 |
| 29 | Z | 29 | 1070 | 20 | 25 | 25 | 500 | 60 | 51 | 49 |

| Steel pipe No. | Tensile characteristics: Yield strength YS (Mpa) | Tensile characteristics: Tensile strength TS (Mpa) | Toughness $vE_{-10°\ C.}$ (J) | GSI value (number of ferrite-austenite grain boundaries/mm) | Corrosion test Corrosion rate (mm/y) | SSC resistance test Presence or absence of cracking | SCC resistance test Presence or absence of cracking | Remarks Present example/ Comparative example |
|---|---|---|---|---|---|---|---|---|
| 1 | 666 | 822 | 169 | 210.8 | 0.010 | ○ | ○ | Present example |
| 2 | 758 | 881 | 48 | 169.3 | 0.010 | ○ | ○ | Present example |
| 3 | 720 | 900 | 83 | 212.0 | 0.010 | ○ | ○ | Present example |
| 4 | 694 | 867 | 99 | 204.0 | 0.010 | ○ | ○ | Present example |
| 5 | 675 | 767 | 118 | 236.1 | 0.010 | ○ | ○ | Present example |
| 6 | 868 | 1058 | 78 | 204.0 | 0.010 | ○ | ○ | Present example |
| 7 | 757 | 850 | 74 | 201.0 | 0.010 | ○ | ○ | Present example |
| 8 | 895 | 1078 | 9 | 113.5 | 0.010 | x | x | Comparative example |
| 9 | 660 | 767 | 9 | 112.3 | 0.010 | x | x | Comparative example |
| 10 | 717 | 853 | 84 | 214.9 | 0.010 | ○ | ○ | Present example |
| 11 | 704 | 880 | 73 | 210.3 | 0.010 | ○ | ○ | Present example |
| 12 | 736 | 886 | 85 | 194.3 | 0.010 | ○ | ○ | Present example |
| 13 | 730 | 901 | 78 | 203.5 | 0.010 | ○ | ○ | Present example |
| 14 | 805 | 914 | 45 | 161.6 | 0.010 | ○ | ○ | Present example |
| 15 | 703 | 790 | 73 | 198.7 | 0.010 | ○ | ○ | Present example |
| 16 | 698 | 784 | 80 | 235.4 | 0.010 | ○ | ○ | Present example |
| 17 | 711 | 808 | 80 | 216.3 | 0.010 | ○ | ○ | Present example |
| 18 | 707 | 822 | 78 | 207.6 | 0.010 | ○ | ○ | Present example |
| 19 | 702 | 807 | 71 | 198.1 | 0.010 | ○ | ○ | Present example |
| 20 | 658 | 812 | 175 | 209.3 | 0.010 | ○ | ○ | Present example |
| 21 | 681 | 841 | 169 | 204.6 | 0.010 | ○ | ○ | Present example |
| 22 | 673 | 831 | 177 | 209.3 | 0.010 | x | x | Comparative example |
| 23 | 668 | 835 | 182 | 212.3 | 0.010 | ○ | ○ | Present example |
| 24 | 666 | 802 | 35 | 175.3 | 0.010 | ○ | ○ | Comparative example |
| 25 | 765 | 933 | 88 | 201.3 | 0.010 | ○ | ○ | Present example |
| 26 | 765 | 944 | 34 | 165.3 | 0.010 | x | x | Comparative example |
| 27 | 509 | 727 | 199 | 251.3 | 0.010 | ○ | ○ | Comparative example |
| 28 | 712 | 868 | 31 | 164.3 | 0.010 | x | x | Comparative example |
| 29 | 847 | 1046 | 30 | 171.3 | 0.010 | ○ | ○ | Comparative example |

* Underline means outside the range of the present invention.
* ○: No cracking
x: Cracking The high-strength dual-phase stainless steel pipes of the present examples all had high strength with a yield strength of 655 MPa or more, low-temperature toughness with a $vE_{-10} \geq 40$ J, and excellent corrosion resistance (carbon dioxide corrosion resistance) in a high-temperature, $CO_2$- and $Cl^-$-containing corrosive environment of 200° C. and higher. The high-strength dual-phase stainless steel pipes of the present examples produced no cracks (SSC, SCC) in the $H_2S$-containing environment, and had excellent sulfide stress cracking resistance, and excellent sulfide stress corrosion cracking resistance. Improved low-temperature toughness with a $vE_{-10} \geq 70$ J was obtained when the GSI value was 176 or more. On the other hand, the comparative examples outside of the range of the present invention did not have the desired high strength, high toughness, or carbon dioxide corrosion resistance according to aspects of the present invention, or generated cracks (SSC, SCC) in the $H_2S$-containing environment.

The invention claimed is:

1. A dual-phase stainless steel of a composition consisting of, in mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: 0.03% or less, and optionally including at least one group selected from the groups A to D consisting of:

Group A: W: 0.02 to 1.5%,

Group B: at least one selected from Zr: 0.50% or less, and B: 0.0030% or less,

Group C: at least one selected from REM: 0.005% or less, Ca: 0.005% or less, Sn: 0.20% or less, and Mg: 0.0002 to 0.01%, Group D: at least one selected from Ta: 0.01 to 0.1%, Co: 0.01 to 1.0%, and Sb: 0.01 to 1.0%, with the balance Fe and unavoidable impurities, the dual-phase stainless steel having a structure that is 20 to 70% austenite phase and 30 to 80% ferrite phase in terms of a volume fraction, a yield strength YS of 655 MPa or more, and an absorption energy $vE_{-10}$ of 40 J or more as measured by a Charpy impact test at a test temperature of −10° C.

2. The dual-phase stainless steel according to claim 1, wherein the stainless steel is a seamless steel pipe and wherein the structure has a GSI value of 176 or more at a central portion in a wall thickness of the steel pipe, the GSI value being defined as a number of ferrite-austenite grain boundaries that are present per unit length of 1 mm of a line segment drawn in a wall thickness direction.

3. A method for producing a dual-phase stainless steel having a structure that is 20 to 70% austenite phase and 30 to 80% ferrite phase in terms of volume fraction, a yield strength YS of 655 MPa or more, and an absorption energy $vE_{-10}$ of 40 J or more as measured by a Charpy impact test at a test temperature of −10° C., the method comprising subjecting a stainless steel of a composition consisting of, in mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: 0.03% or less, and optionally including at least one group selected from the groups A to D consisting of:

Group A: W: 0.02 to 1.5%,

Group B: at least one selected from Zr: 0.50% or less, and B: 0.0030% or less,

Group C: at least one selected from REM: 0.005% or less, Ca: 0.005% or less, Sn: 0.20% or less, and Mg: 0.0002 to 0.01%, Group D: at least one selected from Ta: 0.01 to 0.1%, Co: 0.01 to 1.0%, and Sb: 0.01 to 1.0%, with the balance Fe and unavoidable impurities to the following:

a solution heat treatment in which the stainless steel is heated to a heating temperature of 1,000° C. or more, and cooled to a temperature of 300° C. or less at an average cooling rate of air cooling or faster; and an aging heat treatment in which the stainless steel is heated to a temperature of 350° C. to 600° C., and cooled.

4. The method according to claim 3, wherein the stainless steel is a seamless steel pipe made from a steel material of the composition by heating and hot working the steel material to prepare a steel pipe material, heating the steel pipe material, forming a steel pipe out of the steel pipe material, and shaping the steel pipe, followed by cooling of air cooling or faster, the hot working involving a total reduction of 30% or more and 50% or less in a temperature range of 1,200° C. to 1,000° C.

* * * * *